US006914535B2

(12) United States Patent
Matsukuma et al.

(10) Patent No.: US 6,914,535 B2
(45) Date of Patent: Jul. 5, 2005

(54) LIGHT SCATTERING TYPE SMOKE SENSOR

(75) Inventors: Hidenari Matsukuma, Kanagawa-ken (JP); Manabu Dohi, Kanagawa-ken (JP); Hiroshi Honma, Tokyo (JP); Hiroshi Shima, Kanagawa-ken (JP)

(73) Assignee: Hochiki Corporation (JP)

( * ) Notice: Subject to any disclaimer, the term of this patent is extended or adjusted under 35 U.S.C. 154(b) by 0 days.

(21) Appl. No.: 10/331,616

(22) Filed: Dec. 31, 2002

(65) Prior Publication Data

US 2003/0132849 A1 Jul. 17, 2003

(30) Foreign Application Priority Data

Jan. 11, 2002 (JP) ..... 2002-004221

(51) Int. Cl.[7] ..... G08B 17/10

(52) U.S. Cl. ..... 340/630; 340/628; 340/629; 340/577; 340/578

(58) Field of Search ..... 340/630, 628, 340/629, 577, 578; 250/218, 574; 356/338, 340

(56) References Cited

U.S. PATENT DOCUMENTS 4,596,465 A 6/1986 Nagashima
4,758,733 A * 7/1988 Mochizuki ..... 250/574
5,280,272 A 1/1994 Nagashima et al.
5,587,790 A * 12/1996 Nagashima ..... 356/338
5,642,099 A 6/1997 Nagashima
6,195,014 B1 * 2/2001 Sakurai et al. ..... 250/574

FOREIGN PATENT DOCUMENTS

| | | |
|---|---|---|
| EP | 0 227 320 | 7/1987 |
| EP | 1 327 966 | 7/2003 |
| JP | 59-10606 | 3/1984 |
| JP | 60-10393 | 1/1985 |
| JP | 7-72073 | 3/1995 |

OTHER PUBLICATIONS

European Search Report.

* cited by examiner

*Primary Examiner*—Hung Nguyen
(74) *Attorney, Agent, or Firm*—Blank Rome LLP

(57) ABSTRACT

A light scattering type smoke sensor comprising a holder with openings embedded with light emitting part and light detecting part respectively, which do not protrude into the smoke detection chamber. The optical axis of light emitting part intersects at a predetermined first angle $\alpha$ in the horizontal direction with the optical axis of the light detecting part at a predetermined second angle $\beta$ in the vertical direction. The optical axis of the light emitting part and optical axis of the light detecting part further comprise a configuration angle $\delta$ in the range of 90~120 degrees used as the supplementary angle for the scattering angle $\theta$. Accordingly, the smoke detection part is further constituted in a thin-shaped light scattering smoke sensor which enables the setup of a scattering angle with no directivity in the smoke influx to the smoke detection chamber.

3 Claims, 5 Drawing Sheets

(A)

(B)

(C)

PROJECTION DRAWING FOR ABQP PLANE OPTICAL AXIS (A)

PRIOR ART (B)

PRIOR ART (A)

PRIOR ART (B)

PRIOR ART

LIGHT SCATTERING TYPE SMOKE SENSOR

BACKGROUND OF THE INVENTION

1. Field of the Invention

The present invention relates generally to a light scattering type smoke sensor and more particularly to sensing scattered light caused by smoke particles flowing from the outside into the smoke detection chamber to detect a fire.

2. Description of the Related Art

There is a prior art conventional light scattering type smoke sensor as shown in FIG. 4. FIG. 4(A) shows the lower part of the sensor main body 100 of a sensor equipped with a cover 102 and the smoke detection chamber 103 where smoke flows into the interior section. The sensor main body 100 includes a holder 104 mounted inside the smoke detection chamber 103. The light emitting part 106 and light detecting part 108 are contained within the holder 104 and positioned in proximity to opening 110 and opening 112, respectively.

FIG. 4(B) shows the light emitting part 106 radiating light in the direction of optical axis 114. The monitoring of scattered light caused by the influx of smoke is carried out in the light detecting part 108 from the direction of optical axis 116.

The light emitting part 106 and the light detecting part 108 are disposed so optical axis 114 intersects with optical axis 116 on an imaginary horizontal plane. The scattering angle θ of optical axis intersecting point 118 employs a predetermined setting. At this point the intersecting angle δ of the optical axis supplements the scattering angle θ to determine the configuration angle with the referential of θ=180°−δ.

Furthermore, a light barrier is employed consisting of shielding plate 120 and shielding plate 122. Shielding plate 120 blocks light from passing directly through to the light detecting part 108. Residual direct light reflected from the front side of shielding plate 120 is further reduced by the back shielding plate 122.

Additionally, in this conventional structure as shown in FIG. 4(A), the optical axis of the light emitting part 106 and the light detecting part 108 are arranged at downward grade of about 3~5 degrees, and the optical axis intersecting point is adjusted so that it will not be too close to the upper surface of the smoke detection chamber 103.

However, in this type of conventional light scattering type smoke sensor, as the light emitting part 106, light detecting part 108, shielding plate 120 and shielding plate 122 protrude into the smoke detection chamber 103 where the smoke flows in, the possibility of a problem with the directivity in the influx of smoke from the outside is high.

FIG. 5 shows a prior art light scattering type smoke sensor which is designed not to have directivity in the smoke inflow to the smoke detection chamber 103.

In FIG. 5, the sensor main body 200 is comprised of a cover 202 and a smoke detection chamber 203 into which smoke flows into the main interior cavity. The smoke detection chamber 203 in the sensor main body 200 includes a holder 204, a light emitting part 206 and a light detecting part 208 embedded within opening 210 and opening 212 in holder 204, and thus the structure does not have directivity in the inflow of smoke.

The light emitting part 206 gives off scattered light in the direction of optical axis 214, and the light detecting part 208 subjected to light is located in the direction of optical axis 216. For this reason, on the imaginary vertical plane inside the sensor, the slanting downward arrangement of optical axis 214 and optical axis 216 are positioned so that the light emitting part 206 and the light detecting part 208 are not facing each other. The scattering angle θ of optical axis intersecting point 218 is set at a predetermined angle. In addition, the configuration angle δ has the relation of θ=180 degrees−δ.

On the other hand, as for the type of smoke produced by a fire, the diameter of smoke particles vary from comparatively large to small depending on the burning material. For this reason, let it be one subject there be no difference in the various diameters of smoke particles in respect to sensitivity as much as possible.

It is known that the smoke particle diameter relative to a scattering angle θ of about 60~90 degrees results in the least sensitivity difference (a configuration angle δ90~120 degrees) (Japanese Laid-open Kokai Patent Publication (1995) No. Heisei 7-72073).

However, in the conventional structure shown in FIG. 5, if the scattering angle θ is enlarged to about 60 degrees to lessen the sensitivity difference over the diameter of smoke particles, the optical axis intersecting point 218 drops downward from the installation side holder 204. Consequently, as the vertical side of the scattering angle θ cannot be made into a suitable angle range of 60~90 degrees and to avoid the influence of reflected light from the ceiling side, the height of the sensor (smoke detection part) must be enlarged.

In this case, although a thin-shaped smoke sensor is possible if the interval of the light emitting part 206 and the light detecting part 208 are narrowed to form a scattering angle θ of 60~90 degrees, the problems of electrical induction to the light detecting part or the influence of unacceptable direct light leaking through occurs. Therefore, since it is necessary to separate the light emitting part and the light detecting part as much as possible, along with maintaining a scattering angle θ of 60~90 degrees without changing the height of the smoke detection chamber, a sensor with a thin-shaped smoke detection part cannot be made.

The purpose of this invention constitutes a thin-shaped smoke detection part, which enables the setup of a scattering angle with no directivity in the smoke influx to the smoke detection chamber.

Furthermore, the light emitting part and light detecting part of the smoke scattering senor are arranged to keep them separated as much as possible to block out direct light.

SUMMARY OF THE INVENTION

The present invention has been made in view of the circumstances mentioned above. To achieve this end and in accordance with the present invention, there is provided a light scattering type smoke sensor comprising a plurality of labyrinth members formed around the periphery of the smoke detection chamber to intercept light entering from the outside and for facilitating the inflow of smoke from the outside, a light emitting part for emitting light toward the smoke detection chamber constituted by the labyrinth members, a light detecting part which receives light scattered by the smoke particles in the smoke detection chamber from the light emitting part, a holder with openings embedded with the light emitting part and the light detecting part which do not protrude into the smoke detection chamber, and the optical axis of the light emitting part intersects at a predetermined first angle α in the horizontal direction with the optical axis of the light detecting part at a predetermined second angle β in the vertical direction.

In other features of the present invention, the optical axes further comprise a configuration angle δ in the range of 90~120 degrees used as the supplementary angle for the scattering angle θ.

Thus, it is in the sensor structure of this invention, the running out height from the attachment plane side of the optical axis intersecting point to the smoke detection chamber can be made lower and miniaturization of the whole smoke detection part can be further attained.

Moreover, the particle selectivity of smoke can be reduced by setting the scattering angle θ of the optical axis intersecting point for the light emitting part and the light detecting part in the range of 60~90 degrees.

Furthermore, the running out height of the optical axis intersecting point is low in relation to the attachment plane so as to not approach the light emitting part and the light detecting part. This is necessary to counter well-known problems caused by electrical induction and the influence of direct light leak in the proximity of the light detecting part, which do not occur in the present invention.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Preferred embodiments of the present invention will hereinafter be described in detail with reference to the drawings.

Figure 1:
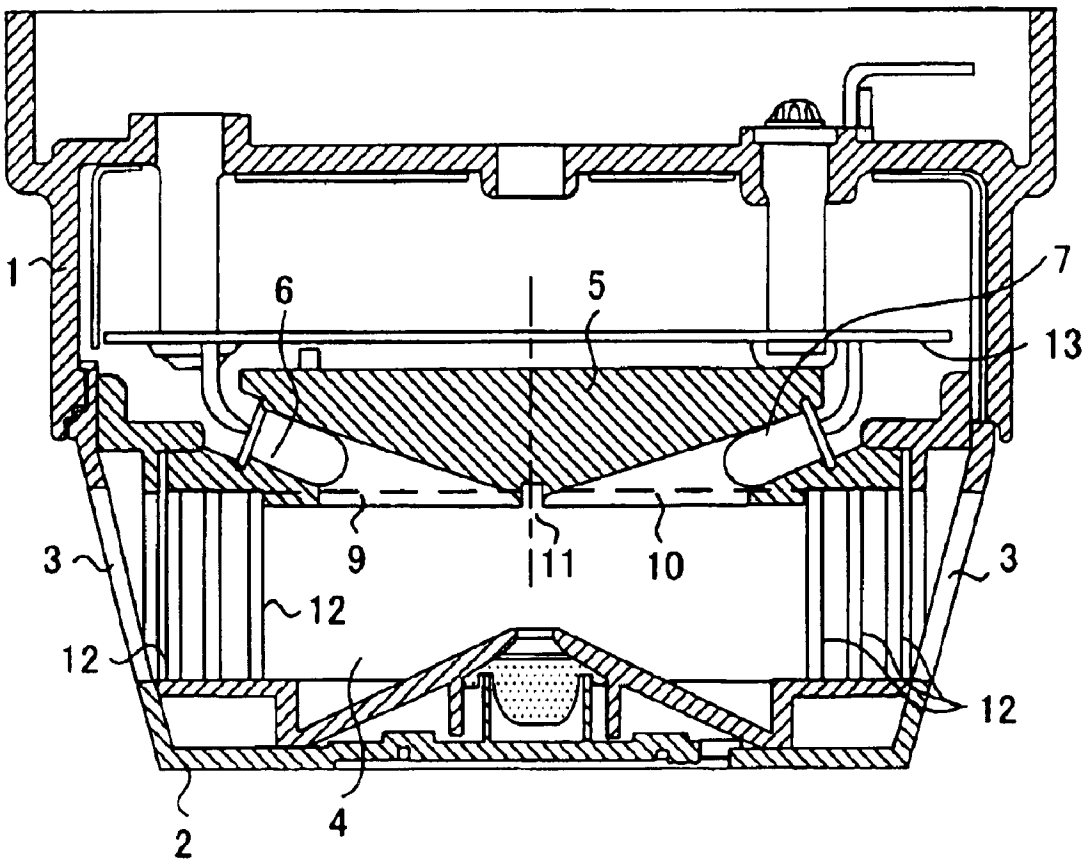
FIG. 1 is a cross sectional view showing the an embodiment of the light scattering type smoke sensor according to the present invention.

Referring now to FIG. 1, there is depicted a cross sectional view of the light scattering type smoke sensor constructed in accordance with the first embodiment of the present invention. In FIG. 1, the light scattering type smoke sensor of the first embodiment consists of a sensor main body 1 and a cover 2. In the lower part of the sensor main body 1 in cover 2 the smoke detection chamber 4 is formed, and the smoke generated by a fire flows into the smoke influx entrance 3 around the periphery of cover 2. The holder 5 is arranged at the upper part of the smoke detection chamber in the sensor main body 1. The light emitting part 6 and light detecting part 7 are located in holder 5.

Openings 9 and 10 are separated by light trap 11 and respectively disposed with the light emitting part 6 and light detecting part 7 in the smoke detection chamber 4. Encircling holder 5 in the smoke detection chamber 4 are labyrinth members 12 formed around the periphery. The incidence of light from the outside is intercepted while at the same time provides a path for smoke from the outside to flow in easily. The circuit board 13 is located at the upper part of holder 5 in the sensor main body 1. The circuit board 13 is attached to and supports holder 5, as well as connected to the lead wire of the light emitting part 6 and light detecting part 7 to perform emission drive and optical processing.

Figure 2:
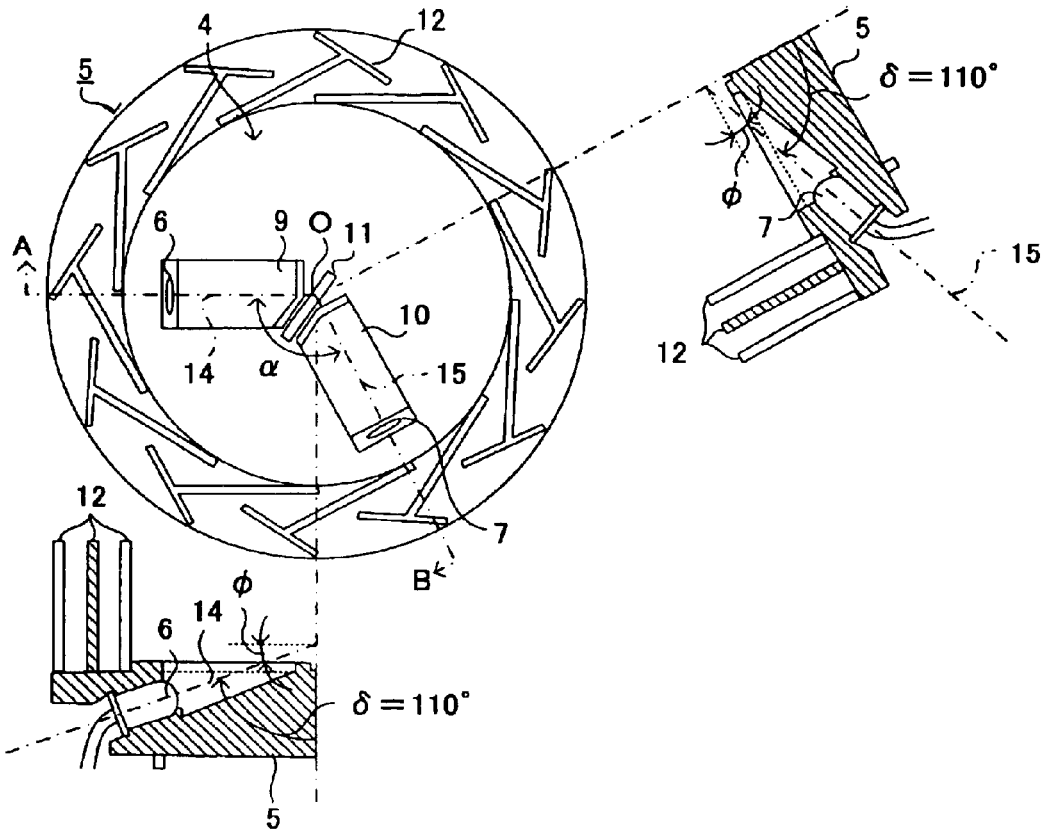
FIG. 2 is a plane view of the holder alignment for the light emitting device and light detecting device shown in FIG. 1.

FIG. 2 is a plane view of holder 5 from the smoke detection chamber 4 side shown in FIG. 1. The holder 5 encircles the internal smoke detection chamber 4 with labyrinth members 12 formed around the periphery to block direct light yet allow smoke to freely flow in from the outside. In the smoke detection chamber 4 surrounded by labyrinth members 12, a light emitting part 6 and a light detecting part 7 are embedded in the inner part of openings 9 and 10 inward toward the center point of the holder side and arranged facing upwards.

When the optical axis 14 from the light emitting part 6 and the optical axis 15 from light detecting part 7 are set as illustrated in FIG. 2, they intersect at the configuration angle α (first angle) on a seemingly horizontal plane. The optical axis 14 of the light emitting part 6 also has an angle φ (second angle) in the vertical direction, which can be clearly seen from the bottom cross-sectional portion of holder 5 from the point of intersection O of optical axis 14 and optical axis 15. Similarly optical axis 15 of the light detecting part 7 has an angle φ inclination in the vertical direction which can be clearly seen from the upper right cross-sectional portion of holder 5 embedded with light detecting part 7 and taken from the O-B section of holder 5.

Accordingly, both the light emitting part 6 optical axis 14 and light detecting part 7 optical axis 15 embedded in holder 5 have a predetermined angle in the horizontal and vertical directions. Therefore, even if the actual setting of the scattering angle θ is θ=60~90 degrees, the amount of run out of the optical axis intersecting point 0 from the holder side 5 to the smoke detection chamber 4 is low and a thin-shaped smoke detection part can be realized.

FIG. 3(A) is the light emitting part 6 and the light detecting part 7 expressed in three-dimensional coordinates showing the optical position relationship corresponding to the installation position in holder 5 of FIG. 2.

In FIG. 3(A), a vector shows the light emitting optical axis 14 of light emitting part 6 from the light emitting point P, and the vector to light detecting point Q shows the light detecting optical axis 15 of the light detecting part 7 in which scattered light makes incidence at the optical axis intersecting point 0.

In the smoke sensor structure of the present invention for scattered light type smoke detection, the imaginary optical side forms a triangle which connects light emitting point P, the optical axis intersecting point 0, and the light detecting point Q. In this POQ triangle, the horizontal plane is formed by the xy plane and the vertical plane is formed by the zx plane arranged at a certain angle.

For ease of explanation, by projecting up the x-axis of light emitting point P so that it is arranged and becomes projecting point A, the angle of inclination φ in the vertical direction of the light emitting optical axis 14 serves as the angle for the x-axis in this case.

If the xy plane of light emitting optical axis 14 and the optical axis 15 are seen from the horizontal plane, as shown in FIG. 3(B), the projecting point A corresponds to the light emitting point P and the projecting point B corresponds to light detecting point Q.

More specifically, the light emitting optical axis 14 and the light detecting optical axis 15 are set in the horizontal direction and cross the predetermined angle α. Conversely, the light emitting optical axis 14 and light detecting optical axis 15 are projected on plane ABQP, and as shown in FIG. 3(C), the light emitting optical axis 14 and light detecting optical axis 15 cross the predetermined angle β in the vertical direction.

Figure 3:
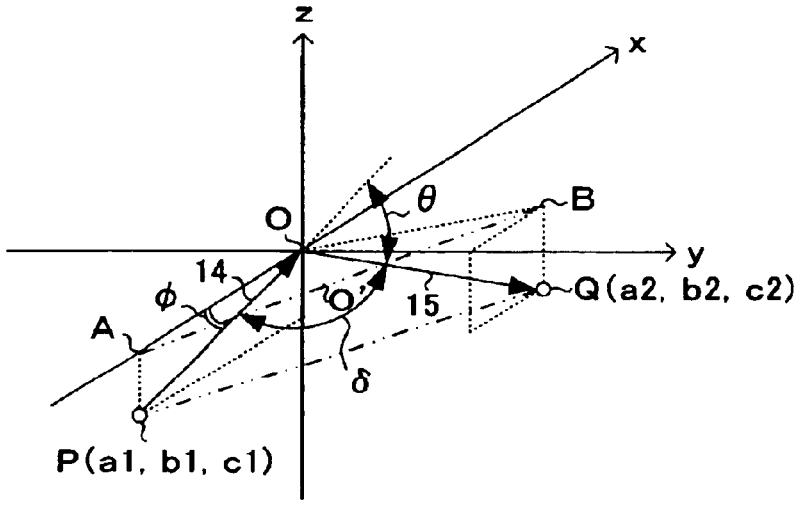
FIG. 3 shows the principle alignment structure of the light emitting device and light detecting device in three-dimensional coordinates.
Figure 3:
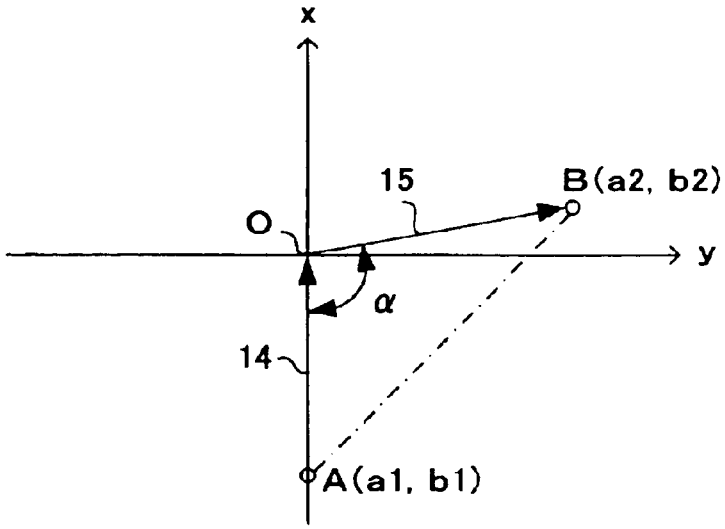
Figure 3:
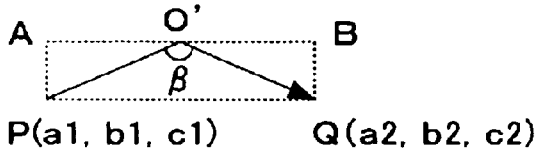
Figure 4:
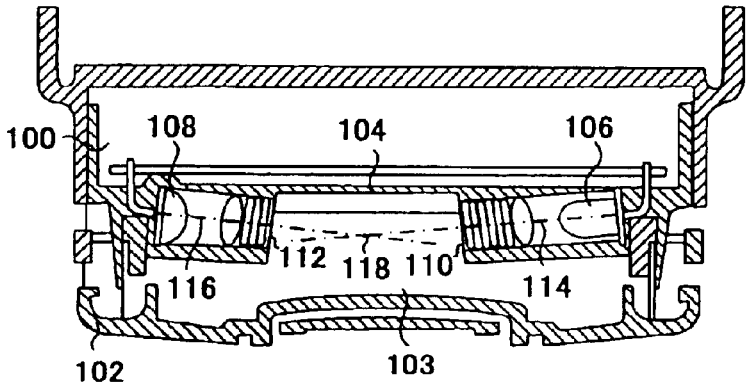
FIG. 4 shows the structure of a conventional sensor.
Figure 4:
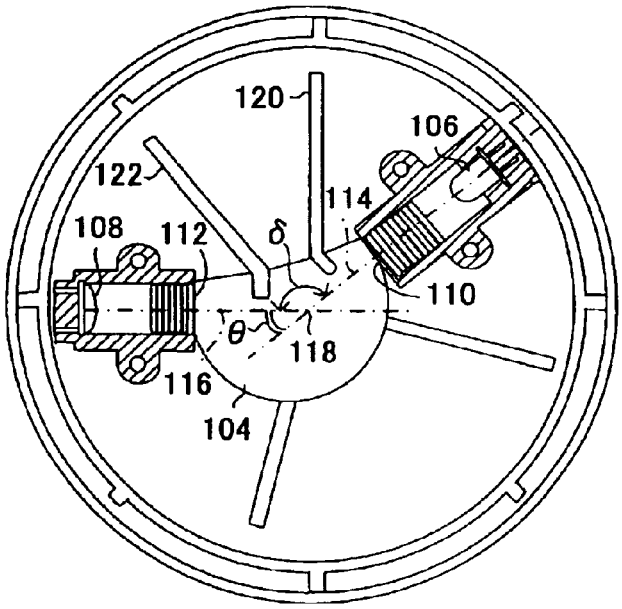
Figure 5:
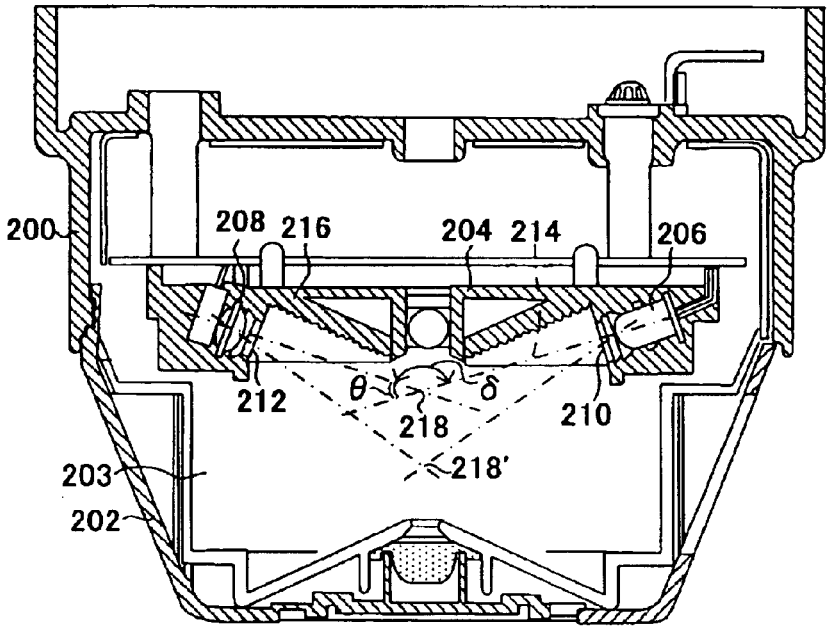
FIG. 5 shows the structure of a conventional sensor whereby the light emitting part and light detecting part do not protrude into the smoke detection chamber.
Figure 5:
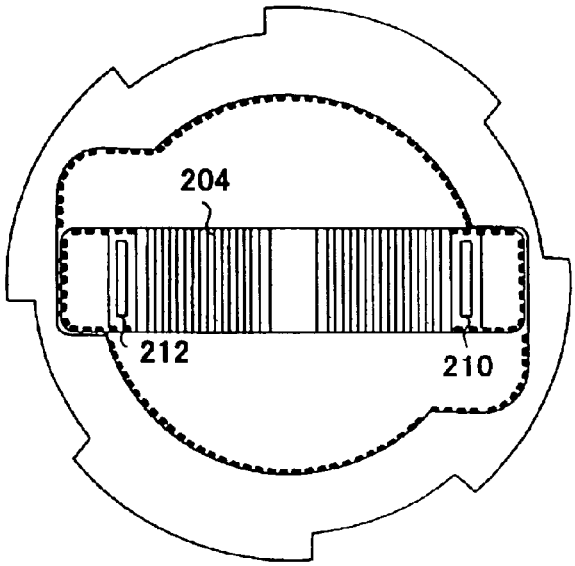

Then, when the coordinates of the light emitting point P are set to (a1, b1, c1) and the coordinates of light detecting point Q are set to (a2, b2, c2), as shown in FIG. 3, the resulting configuration angle δ, the configuration angle α on a horizontal plane above, the perpendicular angle of orientation ϕ, and the vertical component configuration angle β of the light emitting optical axis 14 and light detecting optical axis 15 projected on plane ABQP are expressed in the following formulas:

$$\mathrm{COS}\delta = \frac{a_1a_2 + b_1b_2 + c_1c_2}{\sqrt{a_1^2 + b_1^2 + c_1^2}\sqrt{a_2^2 + b_2^2 + c_2^2}} \quad (1)$$

$$\mathrm{COS}\alpha = \frac{a_1b_1 + a_2b_2}{\sqrt{a_1^2 + b_1^2}\sqrt{a_2^2 + b_2^2}} \quad (2)$$

$$\tan\phi = \frac{c_1}{a_1} \quad (3)$$

$$\mathrm{COS}\beta = \frac{c_1c_2 - M}{\sqrt{M + c_1^2}\sqrt{M + c_2^2}} \quad (4)$$

$$M = \frac{(a_1 - a_2)^2}{4} + \frac{(b_1 - b_2)^2}{4}$$

It is evident the configuration angle θ on plane ABQP becomes larger when the perpendicular oriented angle of inclination ϕ becomes larger as shown in FIG. 3. To simplify the explanation below, the configuration angle δ of the light emitting optical axis 14 and the light detecting optical axis 15 is described using the perpendicular oriented angle of inclination ϕ and the configuration angle α on the horizontal plane.

For example, when the perpendicular oriented angle of inclination ϕ is set to 30 degrees and the light emitting point P coordinates are set to (a1, b1, c1) which are equal to (√3, 0, −1) and the light detecting point Q coordinates are set to (a2, b2, C2) which are equal to (√3/2, 3/2, −1), the resultant configuration angle δ becomes about 97 degrees and the upper horizontal plane configuration angle α becomes 120 degrees based on the above formulas (1) and (2).

Moreover, when the horizontal plane configuration angle α=120 degrees result is maintained and only the perpendicular oriented angle of inclination ϕ is changed to the light emitting point P coordinates set to (a1, b1, c1) which are equal to (−√3, 0, −0.3) and the light detecting point Q coordinates set to (a2, b2, c2) which are equal to (√3/2, 3/2, −0.3), in this case the resultant angle of inclination ϕ becomes 9.8 degrees and the actual configuration angle δ becomes about 117 degrees based on the above-mentioned formula (1).

In summary, based on the constant configuration angle α equals 120 degrees, the resultant angle of inclination ϕ equals 9.8 degrees as opposed to 30 degrees which corresponds to the actual configuration angle δ of 117 degrees as opposed to 97 degrees. Accordingly, when the position of the horizontal direction of the light emitting point P and the light detecting point Q remain unchanged, if the perpendicular oriented angle of inclination ϕ is enlarged, the relationship which makes the actual configuration angle δ smaller is obtained. If the perpendicular oriented angle of inclination ϕ is made smaller, of course, the height of the optical axis intersecting point O will be lower and a more thin-shaped smoke sensor.

Furthermore, although the above explanation used the angle of inclination ϕ, the same can be said of configuration angle β of the vertical component projected on plane ABQP. When the position of the horizontal plane of the light emitting point P and the light detecting point Q remain unchanged, the configuration angle β will be enlarged. As a result, the relevance which makes the actual configuration angle δ smaller is obtained.

As the first embodiment in FIG. 2 and as shown in FIG. 3 expressed in the three-dimensional coordinates, the configuration angle δ of the light emitting optical axis 14 and light detecting optical axis 15 is considered as 110 degrees. Thus, using the configuration angle δ equals 110 degrees, the corresponding scattering angle θ equates to θ equals 180 degrees −δ equals 70 degrees.

As described above in the present invention, in the condition in which the optical axis 14 of light emitting part 6 and the optical axis 15 of light detecting part 7 in holder 5 are set as configuration angle δ equals 90~120 degrees (scattering angle θ 60~90 degrees) and arranged so that the configuration angle α appears in the horizontal plane and the angle of inclination ϕ in the vertical plane, even at optimum angle arrangement the influence on the sensitivity due to the size of smoke particles is little. The height of the optical axis intersecting point O will be lower and a thin-shaped smoke sensor structure can be realized.

In addition to simplify explanation, although the case whereby the light emitting part and the light detecting part are embedded so that the light emitting optical axis 14 and light detecting optical axis 15 can be set up to become equiangular in the vertical angle direction as in the above-mentioned embodiment, on the contrary the light emitting part 6 and light detecting part 7 can be embedded so that they may become the angle from which the light emitting optical axis 14 and a light detecting optical axis 15 differ in the vertical direction, respectively.

As set forth above in detail, the present invention has the following advantages:

(1) An attachment plane as opposed to smoke for the light emitting part and light detecting part embedded in the holder side and arranged at a predetermined angle in both the horizontal and vertical directions. The scattering angle of the optical axis can be set to a suitable scattering angle which is not influenced by the sensitivity to smoke particles, for example 60~90 degrees. The running out height from the attachment plane of the optical axis intersecting point to the smoke detection chamber can be made lower and miniaturization of the whole smoke detection part can be further attained.

(2) Moreover, simultaneous with the thin-shape is the ability to set the scattering angle at a suitable range of 60~90 degrees, thereby mitigating selectivity over smoke particle sensitivity. Furthermore, the light emitting part and the light detecting part can be embedded and installed so that the running out height of the optical axis intersection from the attachment plane to the smoke detection chamber can be made lower, and thereby considered a structure which does not have directivity in the smoke inflow.

While the present invention has been described with reference to the preferred embodiments thereof, the invention is not to be limited to the details given herein.

As this invention may be embodied in several forms without departing from the spirit of the essential characteristics thereof, the present embodiments are therefore illustrative and not restrictive. Since the scope of the invention is defined by the appended claims rather than by the description preceding them, all changes that fall within the metes and bounds of the claims, or equivalence of such metes and bounds thereof are therefore intended to be embraced by the claims.

What is claimed is:

1. A light scattering type smoke sensor comprising:

a sensor main body;

a cover defining a smoke detection chamber within and said cover having a plurality of smoke influx entrances around the periphery for introducing smoke particles into said smoke detection chamber;

a plurality of labyrinth members located within said cover and substantially surrounding said smoke detection chamber for obstructing direct light from crossing said labyrinth members to said smoke detection chamber;

a light emitting part for emitting light toward said smoke detection chamber formed by said labyrinth members;

a light detecting part for receiving light scattered by said smoke particles from said light emitting part in said smoke detection chamber;

a holder for establishing an unrestricted scattering angle $\theta$ so there is no directivity to said smoke particles introduced to said smoke detection chamber which is situated in said sensor main body at the upper part of said smoke detection chamber;

wherein said holder includes openings oriented at opposite facing sides for embedding said light emitting part and said light detecting part without protruding into said smoke detection chamber;

wherein said holder is constituted with said light emitting part and said light detecting part mounted in fixed positions so that the optical axis from said light emitting part which faces said smoke detection chamber and the optical axis of scattered light that is dispersed by said smoke particles in said smoke detection chamber which faces said light detecting part intersect at a predetermined horizontal plane first angle $\alpha$ and intersect at a predetermined vertical plane second angle $\beta$.

2. The light scattering type smoke sensor according to claim 1, wherein said predetermined horizontal plane first angle $\alpha$ and said predetermined vertical plane second angle $\beta$ are set as a configuration angle $\delta$ defined in a range of 90~120 degrees and used as a supplementary angle to said scattering angle $\theta$ by way of crossing the optical axis of said light emitting part and said light detecting part.

3. The light scattering type smoke sensor according to claim 1, wherein said holder further includes a light trap for blocking out direct light from said light emitting part crossing through to said light detecting part.

* * * * *